US009249631B2

(12) United States Patent
Pantzke

(10) Patent No.: US 9,249,631 B2
(45) Date of Patent: Feb. 2, 2016

(54) EXTENDABLE PILOT BIT FOR BARREL CUTTER

(71) Applicant: TEREX USA, LLC, Westport, CT (US)

(72) Inventor: John Pantzke, Estelline, SD (US)

(73) Assignee: Terex USA, LLC, Westport, CT (US)

( * ) Notice: Subject to any disclaimer, the term of this patent is extended or adjusted under 35 U.S.C. 154(b) by 484 days.

(21) Appl. No.: 13/631,860

(22) Filed: Sep. 28, 2012

(65) Prior Publication Data

US 2013/0081877 A1 Apr. 4, 2013

Related U.S. Application Data

(60) Provisional application No. 61/541,167, filed on Sep. 30, 2011.

(51) Int. Cl.
*E21B 10/26* (2006.01)
*E21B 25/00* (2006.01)

(52) U.S. Cl.
CPC ..... *E21B 10/26* (2013.01); *E21B 25/00* (2013.01)

(58) Field of Classification Search
USPC ..... 175/57, 195, 321, 323, 385, 386, 405, 175/202, 332, 334, 403; 172/25
See application file for complete search history.

(56) References Cited

U.S. PATENT DOCUMENTS

| | | | | |
|---|---|---|---|---|
| 3,241,624 | A * | 3/1966 | Rassieur | 175/257 |
| D282,666 | S | 2/1986 | Salmi et al. | |
| 4,598,779 | A | 7/1986 | Liljekvist et al. | |
| 6,129,163 | A | 10/2000 | Hamilton et al. | |
| D441,380 | S | 5/2001 | Hamilton et al. | |
| D457,535 | S | 5/2002 | Hamilton et al. | |
| 6,494,276 | B1 | 12/2002 | Hamilton et al. | |
| 6,619,413 | B2 | 9/2003 | Hamilton et al. | |
| 6,892,834 | B1 * | 5/2005 | Beck, III | 175/385 |
| 6,951,258 | B2 | 10/2005 | Burns et al. | |
| 7,131,506 | B2 | 11/2006 | Hamilton et al. | |
| 7,669,673 | B1 | 3/2010 | Matthias et al. | |

* cited by examiner

*Primary Examiner* — Taras P Bemko
(74) *Attorney, Agent, or Firm* — Simmons Perrine Moyer Bergman PLC

(57) ABSTRACT

A system and method for boring a hole in rock with a digger derrick; which utilizes a hollow stem auger, a kelly bar, and a core barrel with a top support member with a hole therein for receiving the kelly bar with a detachable central pilot bit thereon which is translatable up and down with respect to the core barrel as the kelly bar and auger are manipulated. The kelly bar is selectively positionable with respect to the auger so as to allow the ability to retract the pilot bit inward into the core barrel and to shorten the separation between the pilot bit and the auger.

1 Claim, 2 Drawing Sheets

EXTENDABLE PILOT BIT FOR BARREL CUTTER

CROSS-REFERENCE TO RELATED APPLICATION

This application claims the benefit of the filing date of the provisional patent application with the same title and filed by the same inventor on Sep. 30, 2011, and having Ser. No. 61/541,167 which provisional application is incorporated herein by reference in its entirety.

FIELD OF THE INVENTION

The present invention generally relates to digger derricks and more particularly to core barrels or barrel cutters used with digger derricks.

BACKGROUND OF THE INVENTION

The present invention is related to digger derrick core barrels such as those made by Terex Utilities.

Some core barrels have been outfitted with central pilot bits. While these core barrels with pilot bits have enjoyed considerable success in the industry, they do have some drawbacks. In some applications, it may be desirable to use the pilot bit at the early stages of boring a hole and not at later stages. In such cases, it has been known to stop the drilling process to remove the core barrel, with pilot bit attached, from the partially dug hole in the ground and then remove the pilot bit and resume drilling. This process takes time, requires the presence of a person who is skilled enough to remove the pilot bit, and requires a storage place for the pilot bit.

Consequently, there is a need for improvement in core barrels with pilot bits.

SUMMARY OF THE INVENTION

It is an object of the present invention to provide an economically efficient method and system for boring holes with a core barrel.

It is a feature of the present invention to utilize a core barrel which is configured to couple directly to an auger on a digger derrick.

It is another feature of the present invention to include a core barrel with an extendable pilot bit.

It is another feature of the present invention to provide a unified multi cutting edge replaceable bit head.

It is an advantage of the present invention to provide for reduced time when boring and configuring a digger derrick to and from a core barrel with pilot bit configuration.

The present invention is an interruption-less system and method for boring holes which are designed to satisfy the aforementioned needs, provide the previously stated objects, include the above-listed features, and achieve the already articulated advantages.

The invention comprises: a shaft configured to be coupled to a source of rotary power; a core barrel having a barrel top and a barrel bottom and configured to rotationally couple to said shaft so said shaft is free to translate within said core barrel in a direction from said barrel top toward said barrel bottom; and a pilot bit coupled to said shaft, so that said pilot bit is free to translate within said core barrel in a direction from said barrel top toward said barrel bottom.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
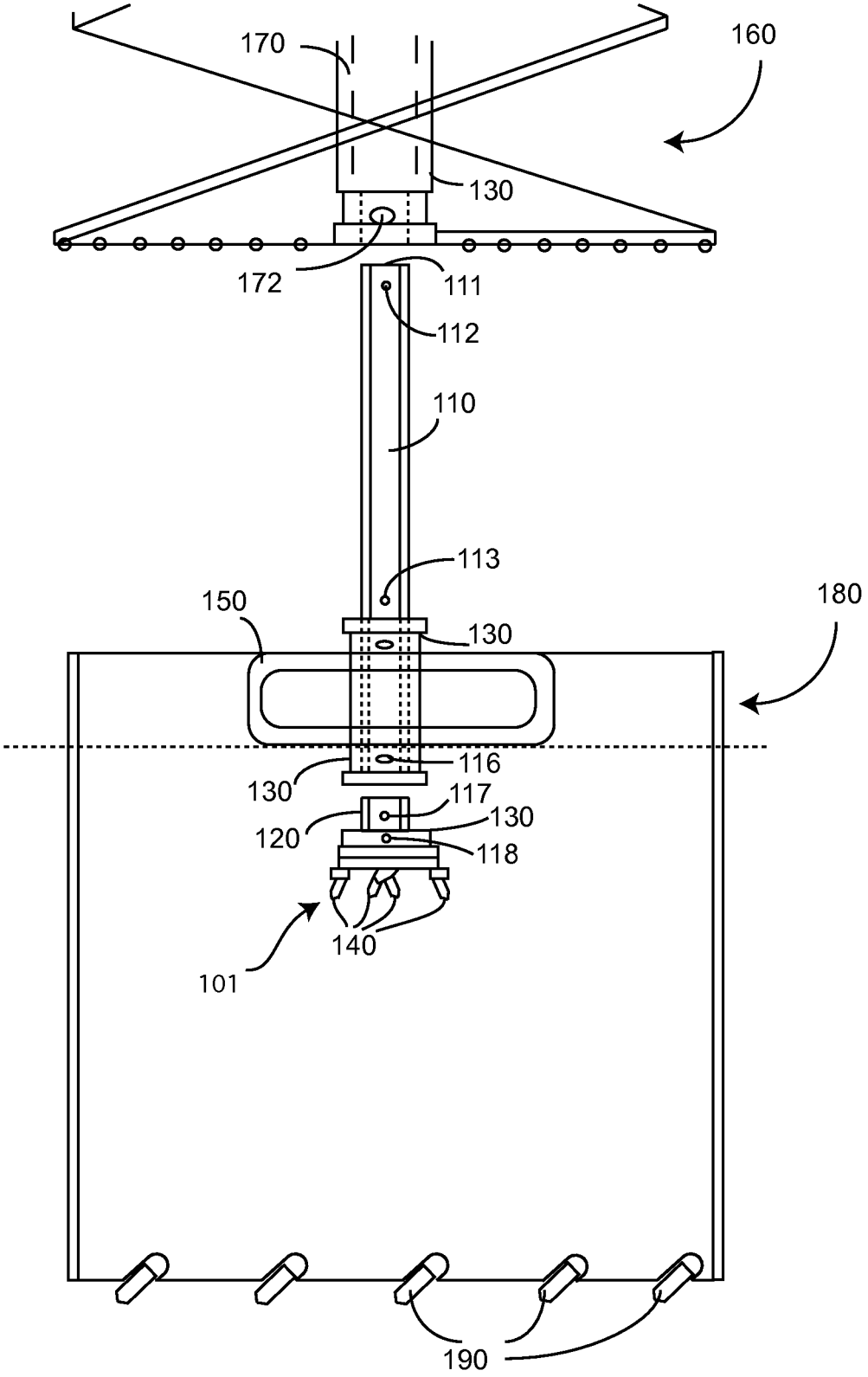
FIG. 1 is a cross-sectional exploded view of an embodiment of the system of the present invention.
Figure 2:
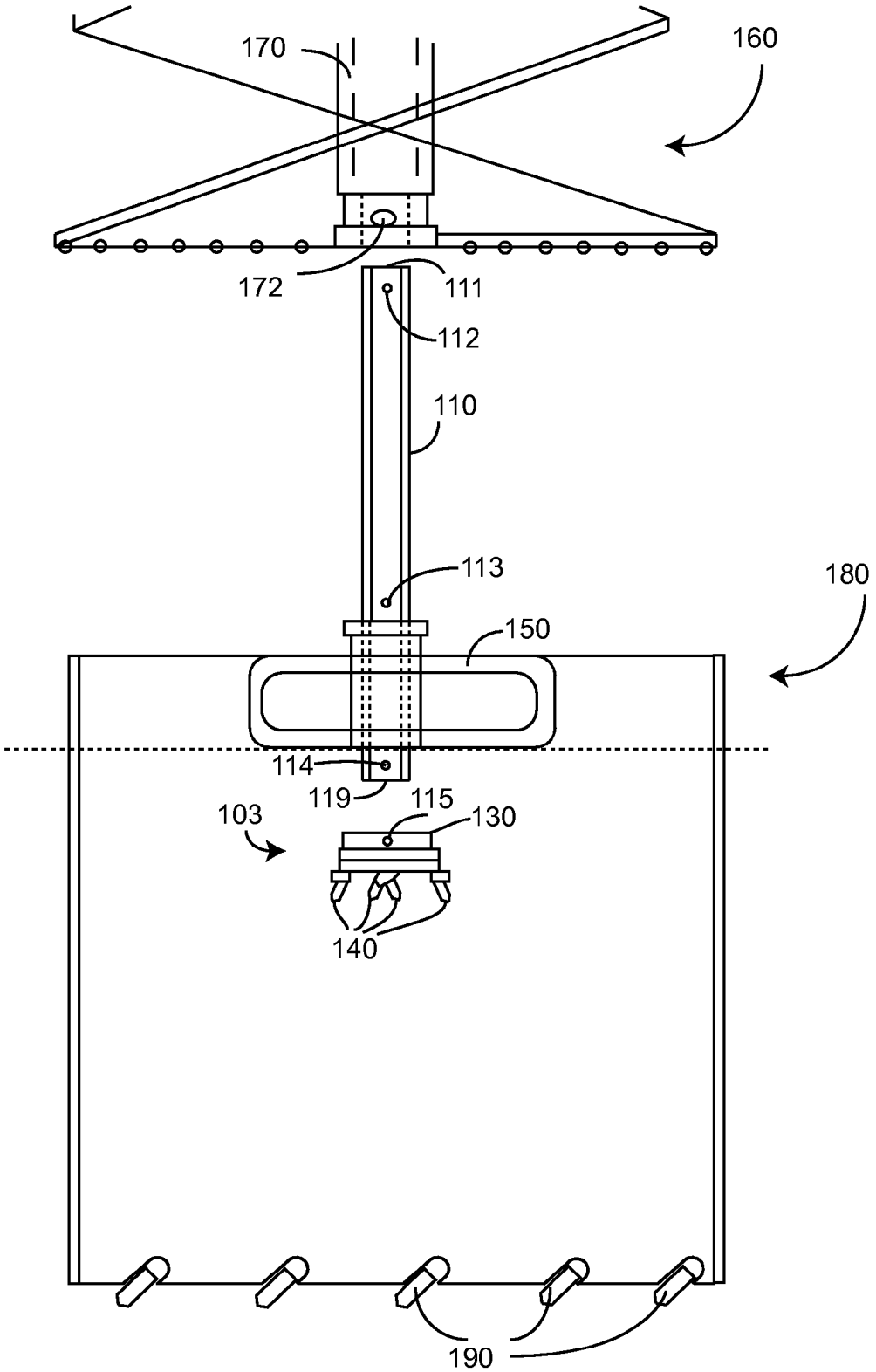
FIG. 2 is a cross-sectional exploded view of an alternate embodiment of the system of the present invention.

Now referring to the drawings, wherein like numerals refer to like matter throughout, and more specifically referring to FIG. 1, there is shown an auger and core barrel combination for use with digger derricks comprising an auger 160 with an integral hollow central stem 170 which has an opening therein for a female coupler 130 sized and configured to receive therein a kelly bar 110, which may be a 2⅝" hexagonal shaft having a top end 111 with a pin receiving hole 112 located nearby. Kelly bar 110 has an intermediate pinhole 113 and a bottom pinhole 114 (FIG. 2.) Also shown is a core barrel 180 with replaceable teeth 190 coupled on a bottom end. At the top end of core barrel 180 and extending transversely from side to side of the core barrel 180 is a rectangular tube support member 150 which may be a 6"×10" rectangular tube of 0.5" thick steel. Other suitable sizes and materials could be substituted. Rectangular tube support member 150 has a hole extending through a top side and a bottom side which is sized and configured to receive therein kelly bar 110. Attached to a top side of support member 150 is female coupler 130. Attached to the bottom end 119 (FIG. 2) of kelly bar 110 is female coupler 130 with a pin receiving hole 116 therein, the combination is able to slide through the support member 150 and thereby bring the bit 101 closer to the bottom of the core barrel 180 and closer to contacting the ground. Attached to the female coupler 130 which is attached to the kelly bar 110 is a short male coupler 120 with a pin receiving hole 117 therein, which could take several forms. Coupled to male coupler 120 is another female coupler 130 with a pin receiving hole 118 therein or an alternate configuration which is coupled to cutting tips 140 which may be welded or alternatively configured to be removable.

Now referring to FIG. 2, there is shown an alternate embodiment of the present invention with a different configuration for mating the pilot bit 103 to the kelly bar 110.

The bottom end 119 of the kelly bar 110 is coupled directly to a female coupler 130 with a pin receiving hole 115 therein which is coupled to and forms a part of a unified replaceable pilot bit 103.

In operation, the present invention can perform as follows:

The top end 111 of kelly bar 110 is inserted into the hollow stem 170 of the auger 160 and coupled thereto. The bottom end 119 of kelly bar 110 is disposed inside the core barrel 180 and has a pilot bit attached thereto. The auger/core barrel combination is moved into place and the auger is rotated causing the core barrel to rotate. The auger is moved downward and the pilot bit is forced deeper into the core barrel 180. The core barrel is contacting the ground but is free to move vertically along the kelly bar until the pilot bit has reached its furthest extent (beyond the bottom of the core barrel 180) when the bottom of the auger 160 mates with top of the core barrel 180, at which time force is being applied to the core barrel which then begins to engage the ground more consistently. Once the core barrel has cut a substantial hole (ring) in the ground or rock, the connection between the auger 160 via hole 172 and the kelly bar 110 is moved from hole 112 to hole 113. This reduces the potential for bending the kelly bar 110.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

I claim:

1. A system for boring holes with a digger derrick comprising;

means for providing rotary power;

means for cutting a cylindrical hole into a layer of rock, with said rotary power;

where said cylindrical hole is at least 12 inches in diameter;

means for cutting a central pilot hole with said rotary power; and said means for cutting a central pilot hole being configured to selectively translate through and beyond a bottom end of said means for cutting a cylindrical hole;

wherein:

said means for providing rotary power comprises:

a digger derrick; and a shaft coupled to and rotated by the digger derrick;

said means for cutting a cylindrical hole comprises a core barrel rotationally coupled to said shaft; and said means for cutting a central pilot hole comprises a pilot bit rotationally coupled to said shaft;

a hollow stem auger disposed between said digger derrick and said shaft and said hollow stem auger being configured for transmitting rotational force between said digger derrick and said shaft;

wherein said core barrel has a barrel top and further comprises a top support member disposed at said barrel top;

said top support member being configured to allow to transmit rotational force from said shaft to said core barrel and to allow said shaft to translate through said core barrel;

wherein said top support member is a rectangular tube extending from side to side across a diameter line of said core barrel; and wherein said shaft has a plurality of differing points of retention with said hollow stem auger so as to provide for an adjustable length of shaft extending between said hollow stem auger and said core barrel.

* * * * *